US006142260A

United States Patent [19]

Shin

[11] Patent Number: 6,142,260

[45] Date of Patent: Nov. 7, 2000

[54] APPARATUS FOR CLOSING HATCH DOORS OF AN ELEVATOR

[75] Inventor: Young Sig Shin, Changwon-Si, Rep. of Korea

[73] Assignee: LG Industrial Systems Co. Ltd., Seoul, Rep. of Korea

[21] Appl. No.: 09/136,406

[22] Filed: Aug. 19, 1998

[30] Foreign Application Priority Data

Aug. 19, 1997 [KR] Rep. of Korea ..... 97-39304

[51] Int. Cl.[7] ..... B66B 13/08

[52] U.S. Cl. ..... 187/333; 187/325; 187/329; 49/360; 16/81

[58] Field of Search ..... 187/313, 318, 187/324, 325, 329, 333, 340, 342, 404, 411, 412, 414; 49/360; 16/81

[56] References Cited

U.S. PATENT DOCUMENTS

| | | | |
|---|---|---|---|
| 920,477 | 5/1909 | Keating | 16/81 |
| 1,966,182 | 7/1934 | McCormick | 187/324 |
| 2,337,716 | 12/1943 | Hall | 16/81 |
| 2,551,032 | 5/1951 | McDonald | 16/81 |
| 3,328,105 | 6/1967 | Trulaske | 16/81 X |
| 3,426,480 | 2/1969 | Dzamba | 187/333 X |
| 4,126,912 | 11/1978 | Johnson | 16/81 |
| 4,357,732 | 11/1982 | Hickman | 16/81 |
| 4,503,637 | 3/1985 | Parente | 49/360 X |
| 5,060,763 | 10/1991 | Garrido et al. | 187/313 X |
| 5,377,448 | 1/1995 | Boyd et al. | 49/360 |
| 5,579,607 | 12/1996 | Braid | 16/81 X |
| 5,606,826 | 3/1997 | Calhoun | 49/360 X |

FOREIGN PATENT DOCUMENTS

| | | | |
|---|---|---|---|
| 530425 | 3/1993 | European Pat. Off. | 16/81 |
| 413007 | 5/1925 | Germany | 49/360 |
| 60-26791 | 2/1985 | Japan . | |
| 6-26265 | 2/1994 | Japan | 49/360 |
| 92181 | 7/1958 | Norway | 16/81 |
| 1730415 A1 | 4/1992 | U.S.S.R. | 49/630 |

*Primary Examiner*—Douglas Hess
*Assistant Examiner*—Thuy V. Tran

[57] ABSTRACT

Disclosed is an apparatus for closing hatch doors of an elevator, which is capable of minimizing a generation of noise during an opening and closing the hatch doors of the elevator. The apparatus for closing the hatch doors of the elevator, according to the present invention a frame which is attached to a wall of a landing in an elevator hoistway, for supporting a pair of door hangers to slidably move on the frame, a pair of hatch doors which respectively have the door hangers attached to each upper portion thereof, which are supported by a sill disposed on the landing, and which are slidable opened and closed along the sill and the frame, and a mechanism for closing the hatch doors of the elevator by using a self-weight thereof when the hatch doors are opened. The apparatus for closing the hatch doors of the elevator according to the present invention as constructed above is applied to various types of elevators and minimizes the noise generated during the opening and closing the hatch doors of the elevator.

12 Claims, 3 Drawing Sheets

APPARATUS FOR CLOSING HATCH DOORS OF AN ELEVATOR

BACKGROUND OF THE INVENTION

1. Field of the Invention

The present invention relates to hatch doors of an elevator, and more particularly to an apparatus for closing the hatch doors of the elevator, which is applied to various types of doors of elevators and which is capable of reducing noise generated during opening and closing the hatch doors.

2. Description of the Prior Art

In general, hatch doors of an elevator, when to be opened and closed, are connected to car doors of the elevator so as to be opened and closed with the car doors of the elevator when the car doors of the elevator are opened and closed. In a special case wherein a system for opening and closing the doors of the elevator malfunctions or the hatch doors do not come into connection with the car doors of the elevator so that the car doors only are closed, however, an undesired accident may occur due to the opening of the hatch doors of the elevator.

In recently developed apparatus, in order to close the hatch doors even though the hatch doors of the elevator are opened due to a malfunction of the system for opening and closing the doors of the elevator, the apparatus for closing the hatch doors of the elevator is mounted on the hatch doors. The apparatus for closing the hatch doors are of two types, namely a spring type and a weight type according to the closing manner. In the spring type of the hatch doors closing apparatus, the hatch doors are closed by using resilient forces of springs, while, in the weight type of the hatch doors closing apparatus, the hatch doors are closed by using the gravitational force of a weight.

Japanese Patent laid-open Publication Showa 60-26791, filed on Jul. 20, 1983 and published on Feb. 9, 1985, discloses a hatch door apparatus of an elevator which is capable of reducing noise generated due to upward and downward moving of a weight in the hatch door apparatus of the elevator and which automatically closes the hatch door apparatus of the elevator.

FIG. 1 is a schematic front view of the hatch door apparatus of an elevator according to the conventional art. Referring to FIG. 1, the hatch door apparatus of the elevator according to the publication comprises hatch doors 4 and 4*a* which are horizontally opened and closed along a rail 3 mounted in a hanger case 2, a guide member 8 which is contained in one of the hatch doors 4 and 4*a*, for having a space extending longitudinally therein, a weight 10 which slidably moves along the space of the guide member 8 upward and downward, a rope 12 of which one end is connected to the weight 10 and the other end is connected to the hanger case 2, and a noise-absorbing member 9 which encloses an outer side of the guide member 8 and absorbs noise generated during upward and downward moving of the weight 10 in the guide member 8.

In the hatch door apparatus according to the publication as constructed above, the noise-absorbing member 9 is disposed between walls of one of the hatch doors 4 and 4*a* and the guide member 8 in order to enclose the guide member 8. The weight 10 is disposed in the space defined by inner surfaces of the guide member 8 as to move upward and downward. The weight 10 is connected to the hanger case 2 by means of the rope 12 which is supported by pulley 13 attached to a door hanger 14*a*. Thus, as the rope 12 is pulled upward with being supported by the pulley 13 when to open the hatch doors 4 and 4*a* of the elevator, the weight 10 also is moved upward along the guide member 8. On the other hand, as the rope 12 is pulled downward with being supported by the pulley 13 when to close the hatch doors 4 and 4*a* of the elevator, the weight 10 also is moved downward along the guide member 8. At this time, the noise-absorbing member 9 can temper noise generated due to a friction between the weight 10, which moves upward and downward in the guide member 8, and the inner surfaces of the guide member 8.

In the hatch door apparatus according to the publication, however, even though the noise-absorbing member can absorb the noise generated due to the upward and downward moving of the weight in the guide member, there is a problem in that it is not possible to perfectly prevent the noise from being transferred into the inner side of the elevator cabin. Furthermore, there is a disadvantage in that processes of making the hatch doors are somewhat complicated because the noise-absorbing member is positioned between the guide member and the walls of the hatch doors in order to prevent the noise from transferring into the space of the elevator cabin.

SUMMARY OF THE INVENTION

The present invention has been made to overcome the above described problems of the prior art. It is an object of the present invention to provide an improved apparatus for closing hatch doors of an elevator capable of preventing noise, which is generated during an opening and closing the hatch doors of the elevator, from being transferred into the interior of the elevator in order to minimize the noise therein.

It is another object of the present invention to provide an apparatus for closing hatch doors of an elevator which can be applied to various types of hatch doors of elevators which can be made separately from hatch doors.

To accomplish the above objects, the present invention provides an apparatus for closing hatch doors of an elevator comprising a frame which is attached to a wall of an elevator hoistway toward a landing portion, for supporting a pair of door hangers which is slidably moved on the frame, a pair of hatch doors which respectively have the door hangers attached to each upper portion thereof, which are supported by a sill disposed on the landing portion, and which are slidable opened and closed along the sill and the frame, and means for closing the hatch doors of the elevator by using a weight which is disposed outside apart from the hatch doors of the elevator in a predetermined distance when the hatch doors are opened.

The frame has a reversed U-shape in a cross section and includes a first side wall having plates mounted thereon by welding so as to be attached via the plates to the wall of the landing, and a second side wall having a rail projected therein through the entire length of the second side wall, a ceiling, a first end wall, and a second end wall.

Each of the door hangers has at least two of conveying rollers mounted thereon and moves slidably along the door rail on the second side wall of the frame.

The hatch doors closing means includes a first pulley which is mounted on the first side wall to be adjacent to the first end wall, a second pulley which is mounted on the first side wall to be adjacent to the second end wall, a weight supporting roller which is mounted on the second side wall to be adjacent to the first end wall, an endless rope for closing the doors, which is movable clockwise and counterclockwise between the first pulley and the second pulley, a first rope connecting plate which is attached to one of the door hangers and to which an upper rope of the endless rope is connected and fixed, a second rope connecting plate which is attached to the other of the door hangers and to which a lower rope of the endless rope is connected and fixed, weight guiding ropes of which each first end is connected to the first end wall and each second end is connected to the sill at a predetermined distance from each other, a weight which can be able to move upward and downward along the weight guiding ropes, and a weight rope of which one end is connected to an upper portion of the weight and the other end is connected to the second rope connecting plate, for moving the weight upward and downward during opening and closing the hatch doors.

The weight comprises a body, a first guiding plate which is mounted on an upper end of the body and connected to the weight guiding ropes, and a second guiding plate which is mounted on a lower end of the body and connected to the weight guiding ropes.

The first and second guiding plates respectively have guiding grooves formed in both end thereof so that the weight guiding ropes are inserted into the guiding grooves and connected to the first and second guiding plates.

The first guiding plate has a thru-hole formed at a center thereof and the body has a recess in a top surface thereof to be corresponding to the thru-hole in the first guiding plate so that a connecting bar, which connects the weight rope to the weight, extends through the thru-hole in the first guiding plate and is combined with the recess of the body.

The first and second guiding plates are made of synthetic resin plates in order to minimize a generation of noise.

In the apparatus for closing the hatch doors of the elevator as constructed above, the weight guiding ropes guide the weight as to move upward and downward while the weight guiding ropes are connected to the guiding plates as to have a minimization of connecting area. This causes the generation of noise to be minimized. Furthermore, since the weight is disposed outside the hatch doors of the elevator, there is an advantage in that the noise can be prevented from being transferred into the inner side of the elevator cabin by means of the hatch doors closing apparatus according to the present invention more than that according to the conventional art which is mounted in the hatch door. There is also the other advantage in that since the apparatus for closing the hatch doors of the elevator according to the present invention can be made separately from the hatch doors, processes for making the hatch doors can be simple.

BRIEF DESCRIPTION OF THE DRAWINGS

The above object and other advantages of the present invention will become more apparent by describing in detail the preferred embodiment thereof with reference to the attached drawings, in which.

DESCRIPTION OF THE PREFERRED EMBODIMENT

Hereinafter, an apparatus for closing hatch doors of an elevator according to a preferred embodiment of the present invention will be described in detail with reference to the accompanying drawings.

Figure 1:
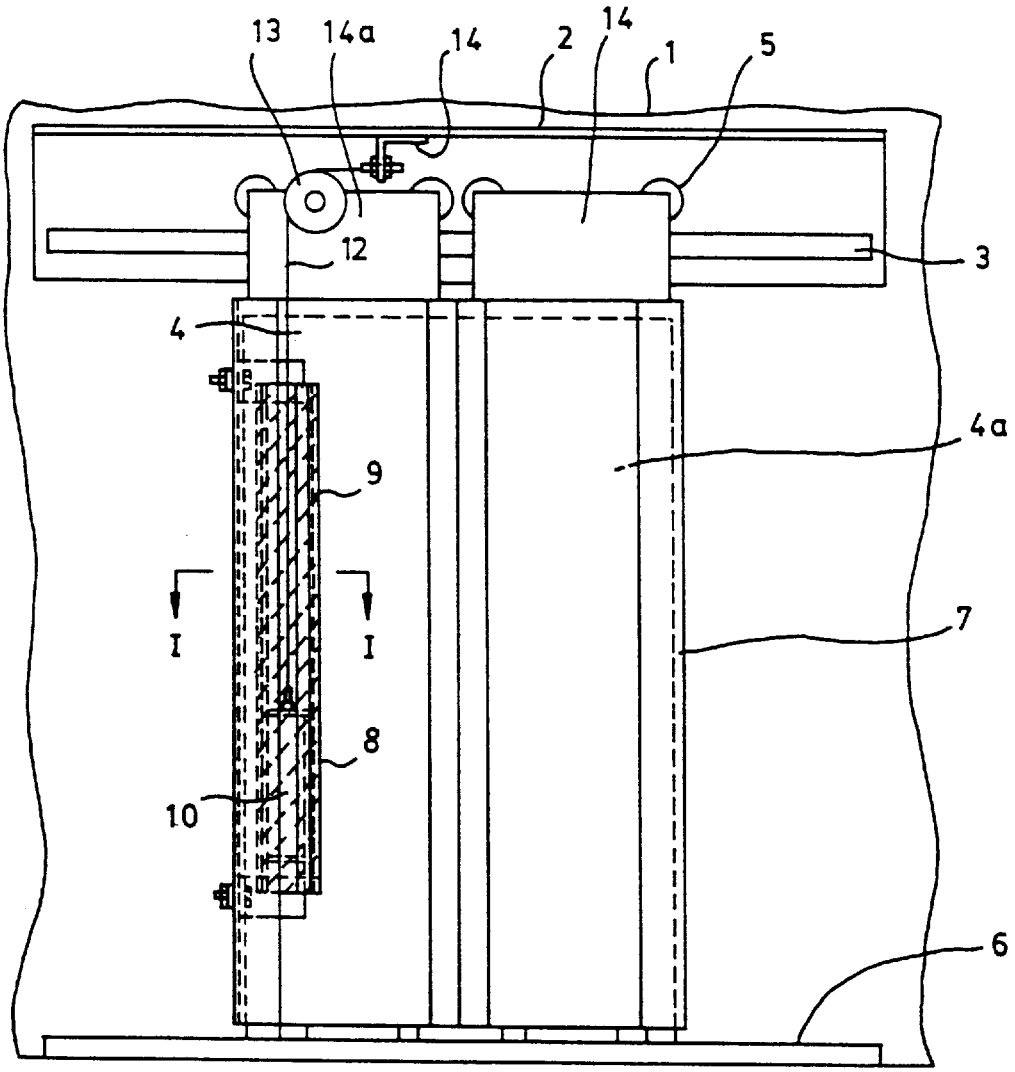
FIG. 1 is a schematic front view of an apparatus for closing hatch doors of an elevator, according to the conventional art.
Figure 2:
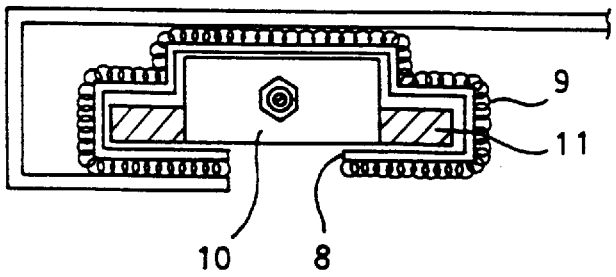
FIG. 2 is a cross-sectional view of the apparatus for closing the hatch doors of the elevator, taken along a line I—I in FIG. 1.
Figure 3:
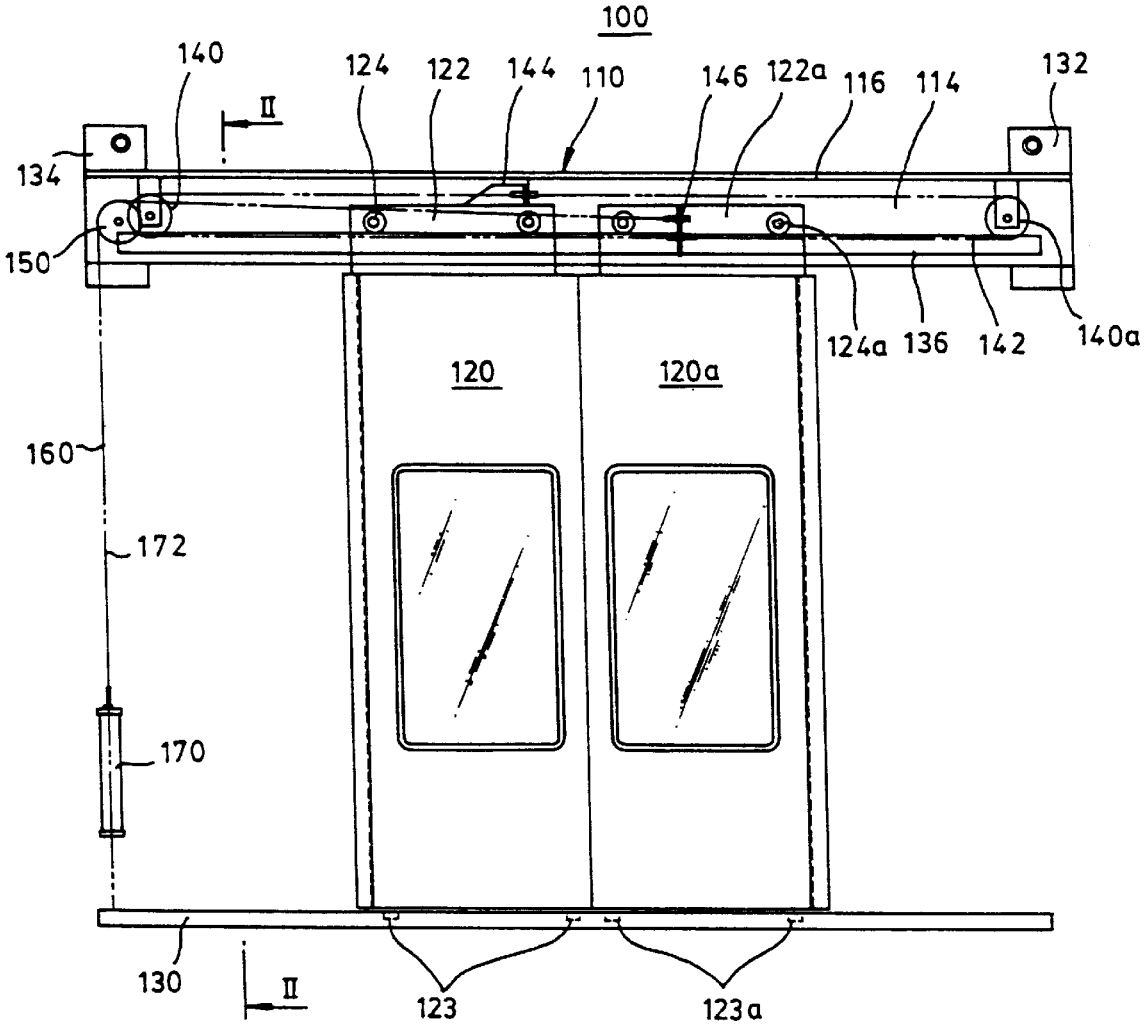
FIG. 3 is a front view of an apparatus for closing hatch doors of an elevator, according to an embodiment of the present invention.

FIG. 3 is a front view of an apparatus for closing hatch doors of an elevator according to an embodiment of the present invention. Referring to FIG. 3, the apparatus 100 for closing the hatch doors of the elevator according to the embodiment of the present invention comprises a frame 110 which is attached to a wall (not shown) of a landing portion in a hoistway, for supporting a pair of door hangers 122 and 122*a* as to slidably move, a pair of hatch doors 120 and 120*a* which respectively have the door hangers 122 and 122*a* attached on each upper portion thereof and which are supported by means of a sill 130 disposed on the landing portion in order to be slidably opened and closed along the sill 130, and a mechanism for closing the hatch doors 120 and 120*a* when the hatch doors 120 and 120*a* are opened.

The frame 110 has a reversed U-shape in a cross-section and extends at a predetermined distance from a longitudinal axis of the elevator cabin to opposite directions normal to the longitudinal axis. The frame 110 includes a first side wall 112, a second side wall 114, a ceiling 116, a first end wall 118, and a second end wall (not shown). Plates 132 and 134 are respectively attached to the first side wall 112 by welding in order to fix the frame 110 to the wall of the landing portion. The second side wall 114 includes a door rail 136 projected to inside thereof through a whole length of the second side wall 114. Furthermore, the mechanism for closing the hatch doors of the elevator is disposed on the frame 110.

The hatch doors 120 and 120*a* respectively have the door hangers 122 and 122*a* respectively attached to each upper end thereof and at least two of projections 123 and 123*a* formed at each lower end thereof. At least two of conveying rollers 124 are mounted on the door hanger 122, while at least two of conveying rollers 124*a* are mounted on the door hanger 122*a*. The door hangers 122 and 122*a* can be slidably moved by means of the conveying rollers 124 and 124*a* along the door rail 136 on the second side wall 114 of the frame 110. The projections 123 and 123*a*, which are formed at the lower end of the hatch doors 120 and 120*a*, are inserted into a groove which is formed through the whole length in the sill 130 disposed on the landing portion, so as to be supported by the sill 130 and to be slidably opened and closed along the sill 130.

The mechanism for closing the hatch doors includes a first pulley 140 which is mounted on the first side wall 112 as to be adjacent to the first end wall 118 of the frame 110, the second pulley 140*a* which is mounted on the first side wall 112 as to be adjacent to the second end wall of the frame 110, a weight supporting roller 150 which is mounted on the second side wall 114 as to be adjacent to the first end wall 118, an endless rope 142 which is movable clockwise and counterclockwise between the first pulley 140 and the second pulley 140*a*, a first rope connecting plate 144 which is attached to the door hanger 122 and to which an upper rope of the endless rope 142 is connected and fixed, a second rope connecting plate 146 which is attached to the door hanger 122*a* and to which a lower rope of the endless rope 142 is connected and fixed, weight guiding ropes 160 and 160*a*, at a predetermined distance from each other, of which one ends are connected to the first-end wall 118 and the other ends are connected to the sill 130, a weight 170 which is movable upward and downward along the weight guiding ropes 160 and 162*a,* and a weight rope 172 of which one end is connected to an upper portion of the weight 170 and the other end is connected to the second rope connecting plate 146, for moving the weight 170 upward and downward during the opening and closing of the hatch doors 120 and 120*a*.

The first and second pulleys 140 and 140*a* are respectively disposed at positions adjacent to the opposite ends of the second side wall 114 as to be rotatably attached to the second side wall 114. The wire rope 142 is suspended on the first and second pulley 140 and 140*a*.

As described above, on the other hand, the rope connecting plates 144 and 146 are respectively fixed to each of door hangers 122 and 122*a*, which in turn are connected to the wire rope 142. Also, the rope connecting plates 144 and 146 have fixtures respectively mounted thereon to connect and fix the wire rope 142 to the door hangers 122 and 122*a*. The first rope connecting plate 144 which is attached to the door hanger 122 is connected by means of the fixture to the upper rope extending between the first pulley 140 and the second pulley 140*a*. The second rope connecting plate 146 which is attached to the second door hanger 122*a* is connected by means of the fixture to the lower rope extending between the first pulley 140 and the second pulley 140*a*. Furthermore, the weight rope 172 is connected by means of the fixture to the second rope connecting plate 146 at one end thereof, which is connected to the weight 170 at the other end thereof. The weight rope 172 in turn is supported and guided by means of the weight supporting roller 150 which is mounted on the inner surface of the second side wall 114.

Figure 4:
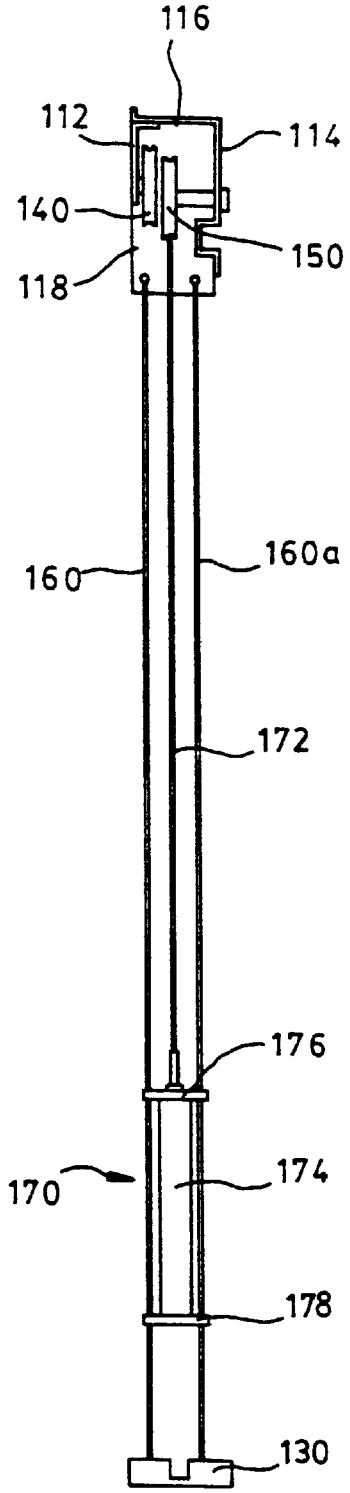
FIG. 4 is a cross-sectional view of the apparatus for closing the hatch doors of the elevator, taken along a line II—II in FIG. 3.

FIG. 4 is a cross-sectional view of the apparatus for closing the hatch doors of the elevator, taken along the line II—II in FIG. 3.

Referring to FIG. 4, it is understood that the weight guiding ropes 160 and 160*a* are respectively connected to a lower portion of the first end wall 118 of the frame 110 at one ends thereof and to an upper surface of sill 130 disposed on the landing portion at the other ends thereof. The weight guiding ropes 160 and 160*a* extend between the first end wall 118 and the sill 130 at the predetermined distance from each other. The weight 170 is disposed between the weight guiding ropes 160 and 160*a* as to be movable upward and downward along the weight guiding ropes 160 and 160*a,* while the weight 170 is suspended on the weight supporting roller 150 by means of the weight rope 172.

Figure 5:
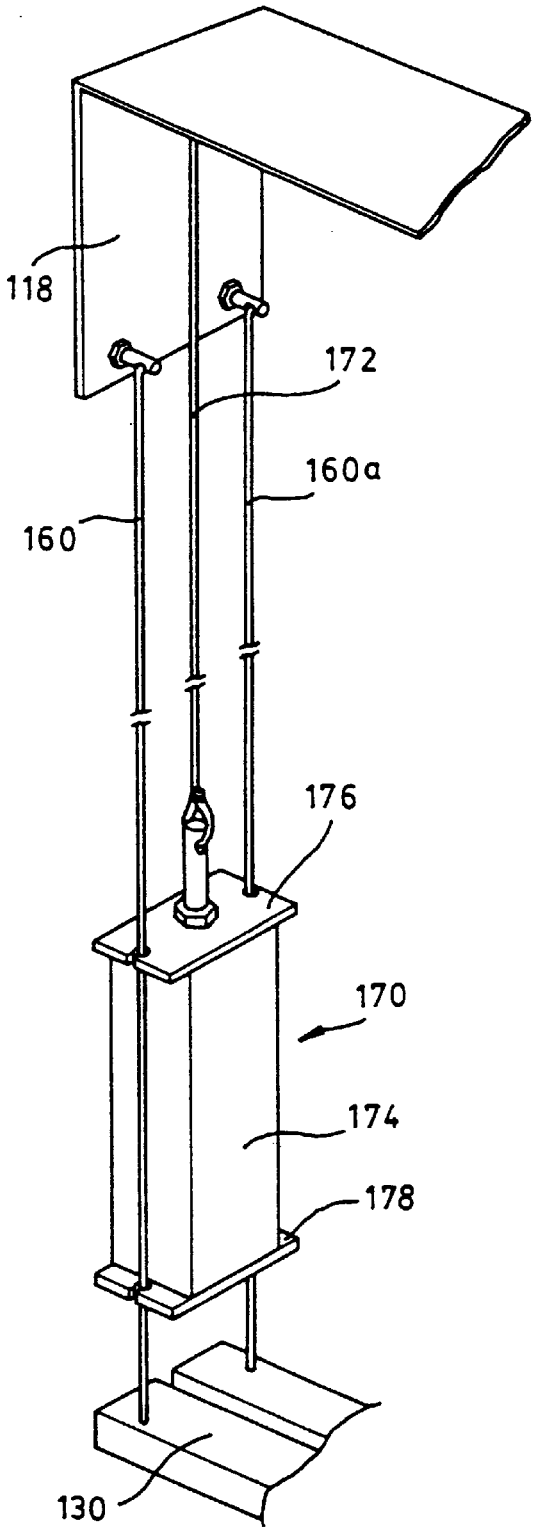
FIG. 5 is a perspective view of a weight of the apparatus for closing the hatch doors of the elevator of FIG. 3.

FIG. 5 is a front view of the weight of the apparatus for closing the hatch doors of the elevator in FIG. 3.

Referring to FIG. 5, the weight 170 comprises a body 174 having an appropriate weight, a first guide plate 176 which is attached to an upper end of the body 174 and connected to the weight guiding ropes 160 and 160*a,* and a second guide plate 178 which is attached to a lower end of the body 174 and connected to the weight guiding ropes 160 and 160*a*.

The body 174 is made of steel and has a rectangular shape. The first and second guide plates 176 and 178 are made of plate which is molded from a synthetic resin, for example nylon resin, in order to minimize a generation of noise. The first and second guide plates 176 and 178 have grooves formed at opposite ends thereof for the weight guiding ropes 160 and 160*a* to be inserted into the grooves and connected to the first and second guide plates 176 and 178.

The first guide plate 176 has a thru-hole formed at the center thereof. The second guide plate 178 also has a thru-hole formed at the center thereof. The body 174 has a recess at a top surface thereof to correspond to the thru-hole of the first guide plate 176 and a recess at a bottom surface thereof to correspond to the thru-hole of the second plate 178. The first and second guide plates 176 and 178 respectively are attached by means of an adhesive to the top and bottom surfaces of the body 174. A rod which connects the weight rope 172 to the weight 170 extends through the thru-hole of the first guide plate 176 so as to be received in the recess of the body 174.

At a top portion of the rod, a thru-hole is formed to connect the weight rope 172 thereto. The rod has a nut mounted on an intermediate portion thereof, which is used to lock the rod in order to prevent the rod from being detached from the body 174 of the weight 170 after combining the rod with the recess.

Hereinafter, the operation of each of the elements of the apparatus for closing the hatch doors of the elevator according to the present invention will be described.

In the apparatus for closing the hatch doors of the elevator according to the present invention, as the elevator moves in the hoistway by an instruction of a control system and then stops at a certain floor, the hatch doors of the elevator are opened and closed in engagement with car doors by means of a door machine mounted on a top surface of the elevator car.

In case that the hatch doors are opened in interlocking with the car door, the door hangers, respectively attached to the upper portions of the hatch doors, move along the door rail of the frame in a direction to opening positions. At this time, the endless rope which is connected to the first and second rope connecting plates are rotated in a direction (hereinafter, referred to as a front direction). The weight rope which is connected to the second rope connecting plate also is pulled in the front direction. Thereby, the weight which is connected to the other end of the weight rope moves upward along the weight guide ropes.

In case that the hatch doors are closed in interlocking with the car doors of the elevator, the door hangers, respectively attached to the upper portions of the hatch doors, move along the door rail of the frame in a direction to closing positions. At this time, the endless rope which is connected to the first and second rope connecting plates are rotated in a direction (hereinafter, referred to as a reversed direction) opposite to the front direction. The weight rope which is connected to the second rope connecting plate also moves in the reversed direction. Thereby, the weight which is connected to the other end of the weight rope moves downward along the weight guide ropes by self-weight.

Furthermore, when the elevator car is not stopped at any floor, the hatch doors occasionally are opened due to a malfunction of the control system of the elevator. In this case, the hatch doors of the elevator are closed by the weight of the apparatus for closing the hatch doors. In the state of that the hatch doors are opened, the weight moves along the weight guide ropes by the self-weight thereof. Then, the weight rope, of which one end is connected to the second rope connecting plate and the other end is connected to the weight, is pulled in the reversed direction so as to move the hatch doors, respectively connected to the second door hangers, in the reversed direction. On the other hand, the lower rope of the endless rope, which is connected to the second rope connecting plate, also is rotated in the reversed direction. Therefore, this causes the upper rope of the endless rope to move in the reversed direction, thereby moving the first door hanger, connected to the upper rope of the endless rope, in the reversed direction. As a result, the hatch doors of the elevator can be closed. As described above, even though the hatch doors of the elevator are opened due to the malfunction of the control system, the hatch doors can be always closed by means of the apparatus for closing the hatch doors.

As described above, the weight moves along the guide ropes. At this time, the guide plates are connected to the guide ropes in such a manner of minimizing a contact area so that little noise is generated. Since the weight is disposed outside apart from the hatch doors of the elevator in a predetermined distance, there is an advantage in that it can be possible to substantially reduce the noise which is transferred into the inner side of the cabin in the elevator using the apparatus for closing the hatch doors more than in the elevator using the hatch door apparatus according to the conventional art. Furthermore, since the apparatus for closing the hatch doors is made separately from the hatch doors, there is other advantage in that the processes of making the hatch doors can be simplified.

While the present invention has been particularly shown and described with reference to a particular embodiment thereof, it will be understood by those skilled in the art that various changes in form and detail may be affected therein without departing from the spirit and scope of the invention as defined by the appended claims.

What is claimed is:

1. An apparatus for closing hatch doors of an elevator comprising in combination:

a frame which is attached to a wall of an elevator hoistway toward a landing portion, for supporting a pair of door hangers which is slidably moved on the frame;

a pair of hatch doors which respectively have the door hangers attached to each upper portion thereof, which are supported by a sill disposed on the landing portion, and which are slidable opened and closed along the sill and the frame; and means for closing the hatch doors of the elevator by using a weight which is disposed outside apart from the hatch doors of the elevator in a predetermined distance when the hatch doors are opened including, a first pulley which is mounted on the first side wall to be adjacent to the first end wall, a second pulley which is mounted on the first side wall to be adjacent to the second end wall, a weight supporting roller which is mounted on the second side wall to be adjacent to the first end wall, and endless rope for closing the doors, which is movable clockwise and counterclockwise between the first pulley and the second pulley, a first rope connecting plate which is attached to one of the door hangers and to which an upper rope of the endless rope is connected and fixed, a second rope connecting plate which is attached to the other of the door hangers and to which a lower rope of the endless rope is connected and fixed, weight guiding ropes of which each first end is connected to the first end wall and each second end is connected to the sill at a predetermined distance from each other, a weight which can be able to move upward and downward along the weight guiding ropes, and a weight rope of which one end is connected to an upper portion of the weight and the other end is connected to the second rope connecting plate, for moving the weight upward and downward during opening and closing the hatch doors.

2. An apparatus for closing hatch doors of an elevator as claimed in claim 1, wherein the frame has a reversed U-shape in a cross section and includes a first side wall having plates mounted thereon by welding so as to be attached via the plates to the wall of the landing, and a second side wall having a rail projected therein through the entire length of the second side wall, a ceiling, a first end wall, and a second end wall.

3. An apparatus for closing hatch doors of an elevator as claimed in claim 2, wherein each of the door hangers has at least two of conveying rollers mounted thereon and moves slidably along a door rail on the second side wall of the frame.

4. An apparatus for closing hatch doors of an elevator as claimed in claim 1, wherein the weight comprises a body, a first guiding plate which is mounted on an upper end of the body and connected to the weight guiding ropes, and a second guiding plate which is mounted on a lower end of the body and connected to the weight guiding ropes.

5. An apparatus for closing hatch doors of an elevator as claimed in claim 4, wherein the first and second guiding plates respectively have guiding grooves formed in both end thereof so that the weight guiding ropes are inserted into the guiding grooves and connected to the first and second guiding plates.

6. An apparatus for closing hatch doors of an elevator as claimed in claim 5, wherein the first guiding plate has a thru-hole formed at a center thereof and the body has a recess in a top surface thereof to be corresponding to the thru-hole in the first guiding plate so that a connecting bar, which connects the weight rope to the weight, extends through the thru-hole in the first guiding plate and is combined with the recess of the body.

7. An apparatus for closing hatch doors of an elevator as claimed in claim 6, wherein the first and second guiding plates are made of synthetic resin plates in order to minimize a generation of noise.

8. An apparatus for closing hatch doors of an elevator comprising in combination:

a frame which is attached to a wall of an elevator hoistway toward a landing portion, for supporting a pair of door hangers which is slidably moved on the frame;

a pair of hatch doors which respectively have the door hangers attached to each upper portion thereof, which are supported by a sill disposed on the landing portion, and which are slidably opened and closed along the sill and the frame; and means for closing the hatch doors of the elevator by using a weight which is disposed outside apart from the hatch doors of the elevator in a predetermined distance when the hatch doors are opened including, weight guiding ropes extending vertically from the sill at a predetermined distance from each other, the weight being movable upward and downward along the weight guiding ropes, and a weight hoisting rope of which one end is connected to an upper portion of the weight and the other end is connected to the wall, for moving the weight upward and downward during opening and closing the hatch doors.

9. An apparatus for closing hatch doors of an elevator as claimed in claim 8, wherein the weight comprises a body, a first guiding plate which is mounted on an upper end of the body and connected to the weight guiding ropes, and a second guiding plate which is mounted on a lower end of the body and connected to the weight guiding ropes.

10. An apparatus for closing hatch doors of an elevator as claimed in claim 9, wherein the first and second guiding plates respectively have guiding grooves formed in both end thereof so that the weight guiding ropes are inserted into the guiding grooves and connected to the first and second guiding plates.

11. An apparatus for closing hatch doors of an elevator as claimed in claim 10, wherein the first guiding plate has a thru-hole formed at a center thereof and the body has a recess in a top surface thereof to be corresponding to the thru-hole in the first guiding plate so that a connecting bar, which connects to the weight rope to the weight, extends through the thru-hole in the first guiding plate and is combined with the recess of the body.

12. An apparatus for closing hatch doors of an elevator as claimed in claim 11, wherein the first and second guiding plates are made of synthetic resin plates in order to minimize generation of noise.

* * * * *